US006062884A

United States Patent [19]

Messimer et al.

[11] Patent Number: 6,062,884

[45] Date of Patent: May 16, 2000

[54] ROTATIONALLY ACTIVATED MULTIPLE PLUG RECEPTACLE ADAPTER

[75] Inventors: Billy Joe Messimer; John Eldon Williams; Gregory Gust Bezat, all of Santa Rosa, Calif.

[73] Assignee: Hybrinetics, Inc., Santa Rosa, Calif.

[21] Appl. No.: 09/151,609

[22] Filed: Sep. 11, 1998

[51] Int. Cl.[7] ..... H01R 29/00

[52] U.S. Cl. ..... 439/172; 439/131

[58] Field of Search ..... 439/171, 172, 439/173, 131, 956

[56] References Cited

U.S. PATENT DOCUMENTS

| | | | |
|---|---|---|---|
| 1,249,247 | 12/1917 | Thomas | 439/173 |
| 2,957,156 | 10/1960 | Gatto et al. | 339/31 |
| 2,989,719 | 6/1961 | Aarlaht | 339/31 |
| 4,518,212 | 5/1985 | Rumble | 339/31 |
| 4,585,286 | 4/1986 | Parr | 439/173 |
| 4,626,052 | 12/1986 | Rumble | 339/31 M |
| 4,856,999 | 8/1989 | Flohr | 439/52 |
| 5,295,845 | 3/1994 | Changxing | 439/173 |
| 5,474,464 | 12/1995 | Drewnicki | 439/172 |

FOREIGN PATENT DOCUMENTS

| | | | |
|---|---|---|---|
| 24 14 203 A1 | 10/1975 | Germany | H01R 27/00 |

*Primary Examiner*—Renee Luebke
*Assistant Examiner*—Michael C. Zarroli
*Attorney, Agent, or Firm*—Flehr Hohbach Test Albritton & Herbert LLP

[57] ABSTRACT

An electrical adaptor. The adaptor includes a plug body with a plurality of plugs each having different plug configurations. Each of the plugs is movable between an extended position, with the plug extending through the outer wall of the plug body, and a retracted position, with the plug being substantially retracted behind the outer wall. The adaptor also includes an actuator coupled to the plug body. The actuator is rotatable relative to the plug body to move the plugs between the extended and retracted positions.

25 Claims, 7 Drawing Sheets

ROTATIONALLY ACTIVATED MULTIPLE PLUG RECEPTACLE ADAPTER

BRIEF DESCRIPTION OF THE INVENTION

The present invention relates in general to an electrical adaptor and, more particularly, to an adaptor which may be used to connect an electrical device to an outlet having one of a plurality of different receptacle configurations.

BACKGROUND OF THE INVENTION

The configuration of the electrical outlet or receptacle varies from country to country, with some countries using more than one outlet style. For example, both old and new style outlets are found in the United Kingdom, requiring a separate plug configuration for each adaptor. Similarly, in Europe there is a recessed socket, in which part of the plug body is inserted into the socket, as well as a flat socket similar to the outlets found in the United States where only the pins of the plug are inserted into the outlet. A variety of adaptors are available to allow an individual to use an electrical device with the different outlet configurations. Depending upon voltage specifications, a voltage converter may also be required. However, a voltage converter typically includes a plug which mates with only one of the various outlet configurations, with an adaptor being required to insert the converter plug into different style receptacles.

In the simplest form, the adaptor includes a receptacle shaped to receive the plug of an electric device and a plug which is designed to fit into a particular outlet. For travelers visiting more than one country, or a country where more than one plug style may be encountered, a collection of different adaptors must be used. However, carrying several different adaptors can be awkward and requires considerable packing space. Further, it is likely that one or more of the adaptors will be misplaced.

U.S. Pat. No. 4,518,212 shows an example of an adaptor which includes more than one plug. The plugs are hidden behind a shutter plate, which is moved by a lever to expose the selected pin configuration. Once exposed, the plugs may be withdrawn from the housing and the individual pins manually rotated to lock the plugs in position. While offering the convenience of multiple plug configurations in a single unit, manipulation of the pins can be difficult and tedious. Moreover, the life of the device may be limited since repeated manipulation of the pins may cause one or more components of the device to break, rendering the device inoperable. U.S. Pat. No. 4,626,052 shows a similar multiple pin adaptor in which the pins for the selected configuration are individually withdrawn from a housing by actuating a plurality of different levers. This device is also complex and confusing to operate, and may be susceptible to early mechanical failure.

Another example of an electric adaptor is shown in U.S. Pat. No. 4,856,999. The adaptor includes a plurality of different plugs mounted to a pentagon-shaped body. The plugs are permanently mounted in place, each plug extending from a different side of the pentagon body. The device includes a rotary body which is rotated to electrically connect one of the plugs to the receptacle. Unlike the previously described devices, the disclosed adaptor is simple to operate. However, since all of the plugs are continuously exposed, additional care must be taken when storing or handling the device to prevent the plugs from snagging or damaging other articles. Moreover, the overall size of the device including the total length of the plugs may prevent the adaptor from being used when the outlets are not located in an exposed area.

An electrical adaptor which may be used with several different outlet configurations is desirable. Similarly, a multiple plug electrical adaptor which is convenient to operate is desirable. An electrical adaptor in which the unused plugs are safely retained in a housing is also desirable, as is such an adaptor which is compact in size.

OBJECTS AND SUMMARY OF THE INVENTION

It is a primary object of the present invention to provide an electrical adaptor which may be used to connect an electric device to one of several different outlet configurations.

It is a further object of the present invention to provide an electrical adaptor which includes a plurality of different plug configurations.

It is another object of the present invention to provide a multiple pin electrical adaptor in which only one plug may be extended to an operational position at a time, the remaining plugs being safely retained inside the adaptor housing.

It is yet another object of the present invention to provide an electrical adaptor which may be conveniently and efficiently manipulated to move the selected plug to an operational position.

A more general object of the present invention is to provide an electrical adaptor which is rugged, compact in size, and which may be economically manufactured.

In summary, the present invention provides an electrical adaptor which may be used to couple an electric or electrical device to one of a plurality of receptacle configurations. The adaptor may include a receptacle for receiving the plug of the device. Alternatively, the adaptor may be permanently wired to the device. The adaptor includes a plug body which contains a plurality of plugs each having different plug configurations. The outer wall of the plug body has a plurality of openings therein which are shaped and positioned so that the plugs may be extended through the outer wall. Each of the plugs is movable between an extended position, with the plug extending through the outer wall, and a retracted position. The adaptor also includes an actuator coupled to the plug body. The actuator is rotatable relative to the plug body to move the plugs between the extended and retracted positions.

Additional objects and features of the invention will be more readily apparent from the following detailed description and appended claims when taken in conjunction with the drawings.

DETAILED DESCRIPTION OF THE INVENTION

Figure 1:
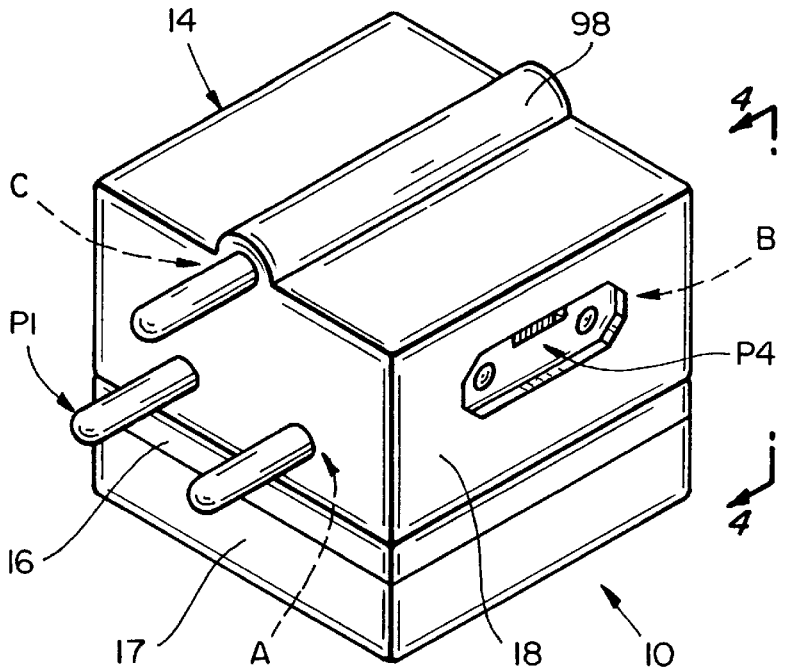
FIG. 1 is a pictorial view of an electrical adaptor in accordance with the present invention, shown with one of the plugs in an operational position.

Reference will now be made in detail to the preferred embodiment of the invention, which is illustrated in the accompanying figures. Turning now to the drawings, wherein like components are designated by like reference numerals throughout the various figures, attention is directed to FIGS. 1–4.

Figure 4:
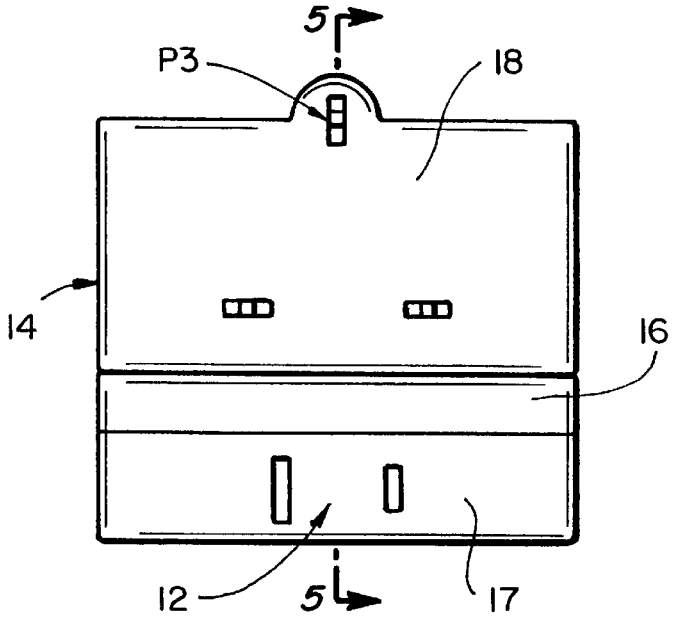
FIG. 4 is an end view taken substantially along line 4—4 of FIG. 1.

FIGS. 1–4 show an electrical adaptor 10 which is particularly suitable for coupling an electronic or electric device (not shown) to a variety of different outlet configurations. In the illustrated embodiment, the electrical adaptor 10 is a stand-alone device which includes a receptacle 12 (FIG. 4) configured to receive the plug of the electric device. The receptacle 12 shown in FIG. 4 is shaped to accommodate polarized plugs in the United States, making the electrical adaptor 10 particularly useful for individuals residing in or originating from the United States. For other users, the receptacle may have other configurations, typically one which matches the outlet configuration of the user's country of origin. In other modifications of the invention, the adaptor 10 may be provided as part of the electronic or electric device. Examples of such devices include a voltage converter, inverter, or any other product used with foreign outlets.

The electrical adaptor 10 generally includes a plug body 14 and an actuator 16 coupled to the plug body 14. In the illustrated embodiment, the plug body 14 has a cubic shaped outer wall or housing 18, although the plug body 14 may have other shapes within the scope of this invention. The actuator 16 includes an receptacle housing 17 which is shaped complementary to the shape and size of the plug body 14 such that the receptacle housing 17 defines the base of the plug body 14, providing the plug body 14 with a substantially stream-lined appearance. However, it is to be understood that the actuator is subject to considerable modification, and may be provided by a knob which is smaller than or larger than the sectional size of the plug body 14.

Figure 2:
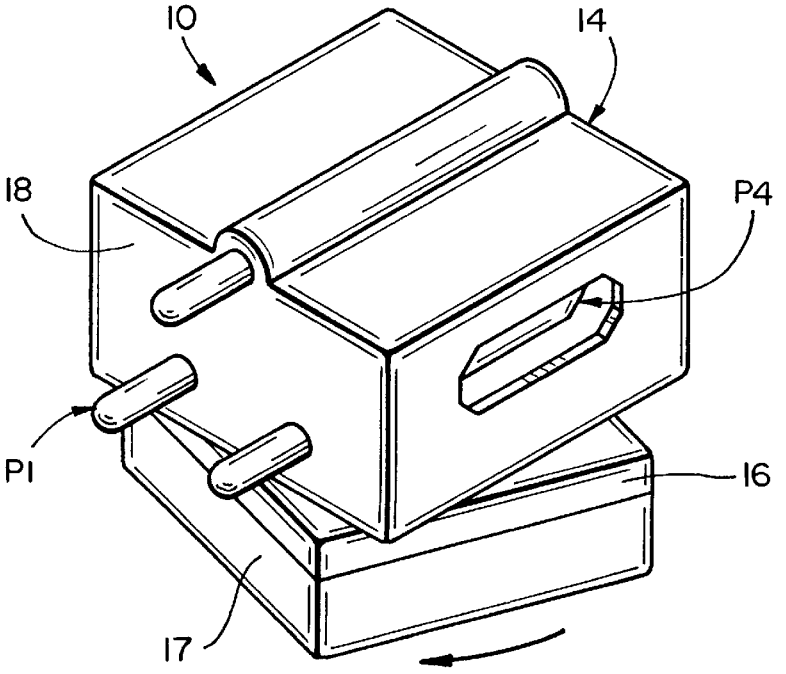
FIG. 2 is a pictorial view of the electrical adaptor of FIG. 1, with the adaptor rotated relative to the plug body to retract one plug and move the next plug to an operational position.
Figure 3B:
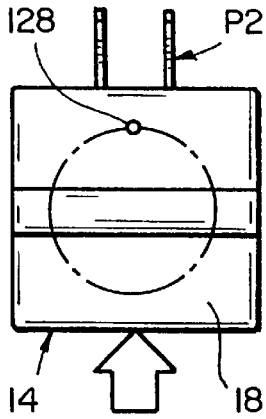
FIGS. 3A–3D are top plan views of the electrical adaptor of FIG. 1, showing the extension of different plugs from the plug body.
Figure 3A:
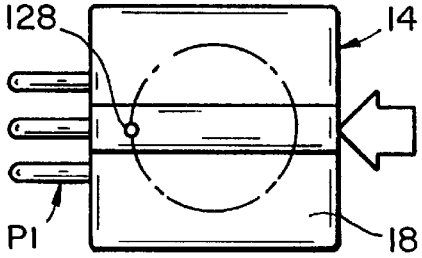
Figure 3C:
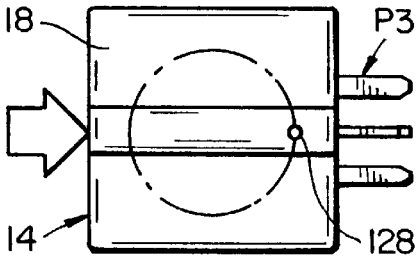
Figure 3D:
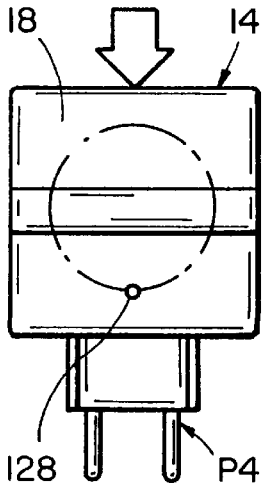

The plug body 14 houses a plurality of plugs, one of which (P1) is shown in an extended operational position in FIG. 1. The other plugs are currently positioned inside of the housing 18 of the plug body 14. As is described in more detail, a different plug may be extended from each side of the plug body 14 by rotating the actuator 16 relative to the plug body 14. As shown in FIG. 2, as the actuator 16 is rotated, the previously extended plug P1 is retracted into the housing 18 while another plug is extended through a different side of the housing. FIGS. 3A–3D show the plugs P1–P4 in an extended, operational position. As shown in the Figures, only one plug is extended from the plug body at a time. Although not shown, two different plugs are extended through the third and fourth sides of the plug body 14 upon further rotation of the actuator 16, providing four different plug configurations. In this embodiment, two of the plugs may be modified when extended from the plug body 14 to provide two additional plug configurations for a total of six plug configurations. In the illustrated embodiment, the available plug configurations carried by the plug body 14 are British-old style, British-new style, North American, Australian, European, and European-recessed. This selection of plug configurations is particularly suitable for most applications. However, it is to be understood that the plug body 14 may include different configurations, or a different number of configurations if desired.

Figure 5:
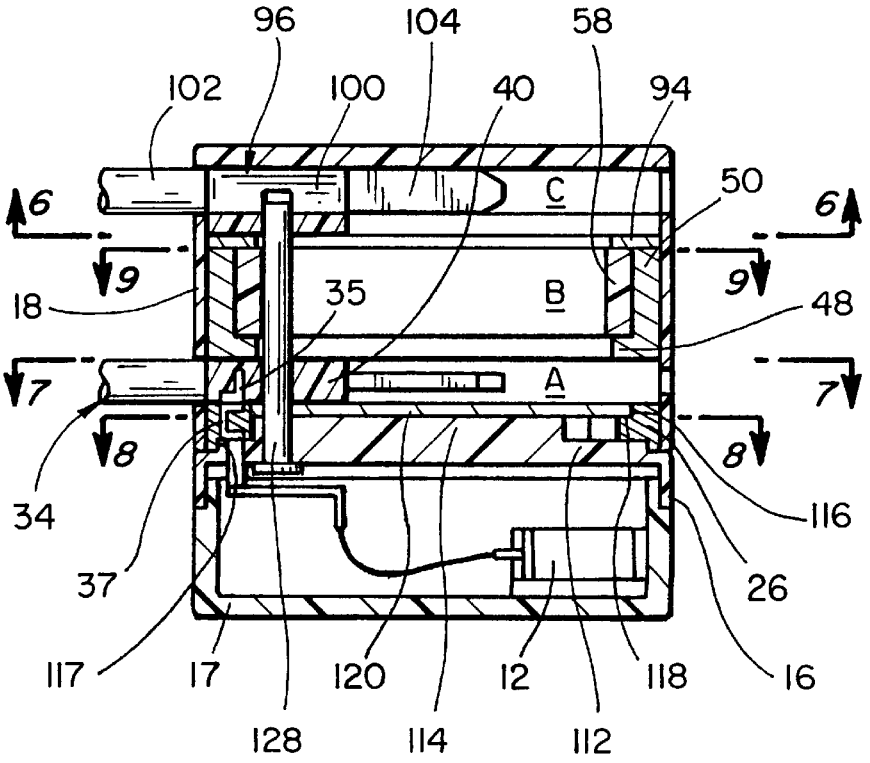
FIG. 5 is a sectional view taken substantially along line 5—5 in FIG. 4.

The interior components of the plug body 14 are arranged such that the pins of the plugs carried by plug body 14 are positioned in one of three layers A, B, and C (FIGS. 1 and 5). For example, the plug P1 shown in the extended position in FIG. 1 includes two pins positioned in layer A and one pin positioned in layer C, while the plug P4 (shown in a retracted position in FIG. 1) is positioned in layer B. The plugs carried by the plug body 14, and the layers A-C, are described in relation to FIGS. 5–12. After the plugs have been described, the components of the actuator 16 and the relationship between the actuator 16 and the plugs will be discussed.

Figure 7:
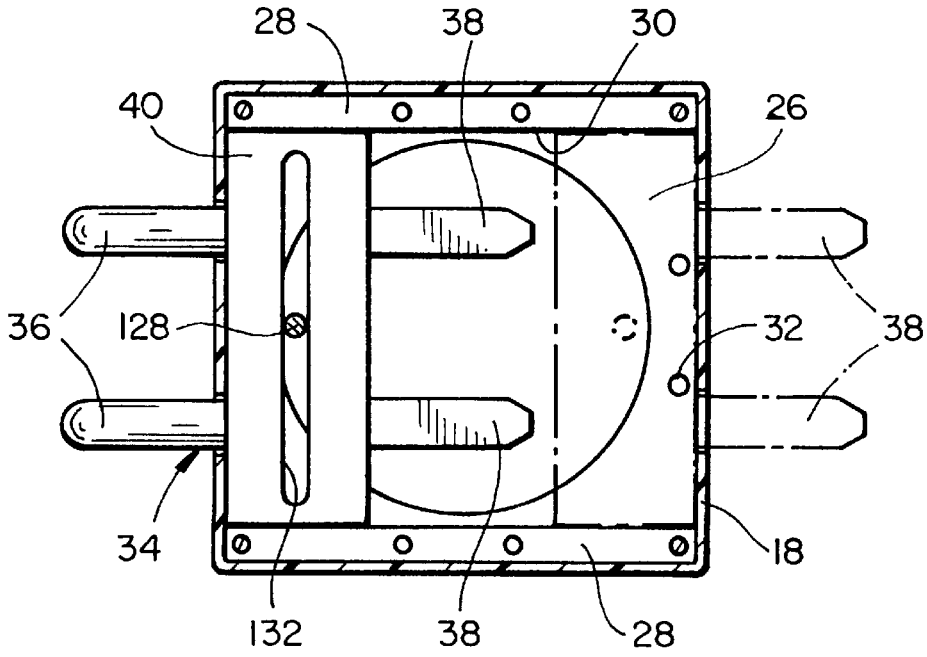
FIG. 7 is a sectional view taken substantially along line 7—7 in FIG. 5.
Figure 8:
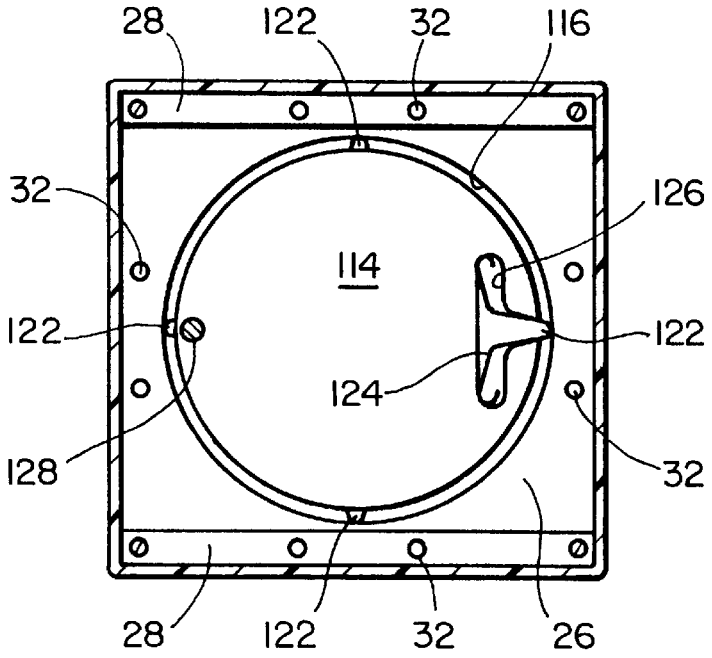
FIG. 8 is a sectional view taken substantially along line 8—8 in FIG. 5.

FIGS. 5 and 7 show the layer A of the plug body 14. The layer A generally includes a base member 26 which is positioned on top of the actuator 16, components of which are shown in FIGS. 5 and 8 and described in more detail below. As shown particularly in FIG. 7, the base 26 includes a pair of spaced, lateral flanges 28 which define a track 30 therebetween. As shown particularly in FIG. 8, the base 26 includes a pair of apertures 32 approximately centered on each of the four sides of the base member 26. Electrical connectors (not shown) are inserted in the apertures to electrically connect each of the plugs to the receptacle 12, or to the device if the adaptor is mounted to the device, when the plug is in an extended, operational position. The apertures 32 formed in the lateral flanges 28 are used to convey the electrical connectors to layer B, while the electrical connectors positioned in the track 30 terminate at layer A.

A pin assembly 34 is positioned in the track 30. The pin assembly 34 generally includes two pins sets each having a pair of spaced pins 36, 38, respectively. In the illustrated embodiment, the pins 36 and 38 form part of the British plug configurations. The pins 36, 38 are mounted to a slider 40 which is shaped to slide along the track 30. The slider 40 slides along the track 30 between two outer positions. FIG. 7 shows in solid lines the slider 40 in one of the outer positions, with the pins 36 extending from the side of the base 26 such that the pins 36 project from the housing 18. In this position, the electrical connectors 37 (shown in FIG. 5) provided in the apertures 32 beneath the slider 40 contact electrical connectors 35 on the underside of the slider 40 to couple the pins 36 to the receptacle 12. In the other outer position, shown in interrupted lines, the slider 40 is substantially aligned with the opposite side of the base 26 such that the pins 38 extend outwardly from the base member 26 and project through the housing 18. The electrical connectors in the apertures 32 contact electrical connectors (not shown) on the underside of tile slider 40 to couple the pins 38 to the receptacle 12. The slider 40 also may be moved to an intermediate position (not shown) in which none of the pins 36, 38 project through the housing 18.

Figure 9:
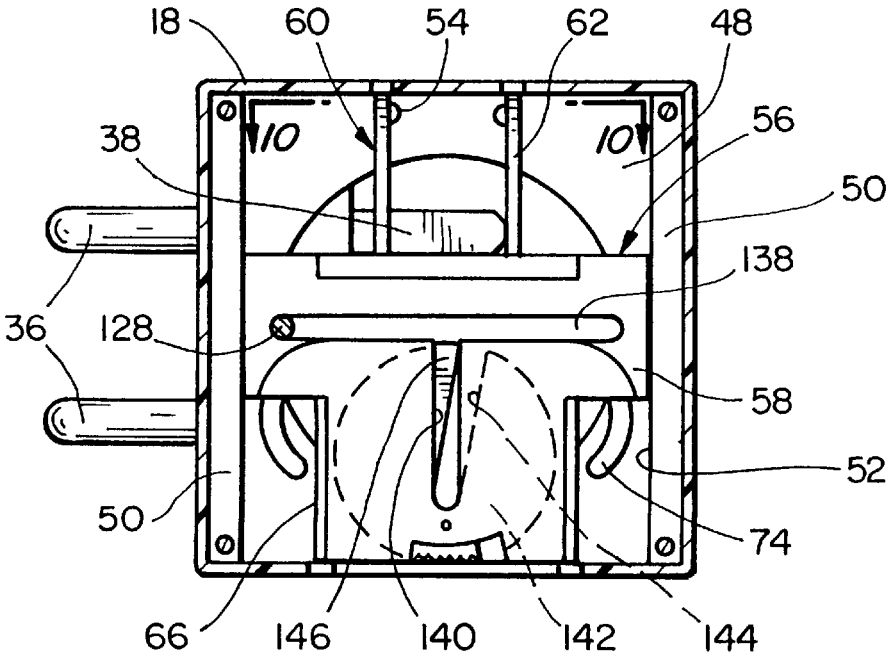
FIG. 9 is a sectional view taken substantially along line 9—9 in FIG. 5.
Figure 10A:
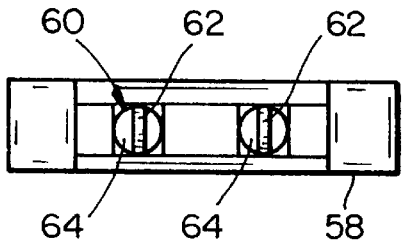
FIGS. 10A and 10B are end views taken substantially along line 10—10 of FIG. 9.
Figure 10B:
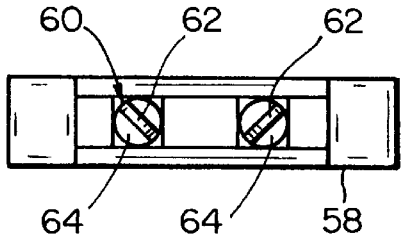
Figure 11:
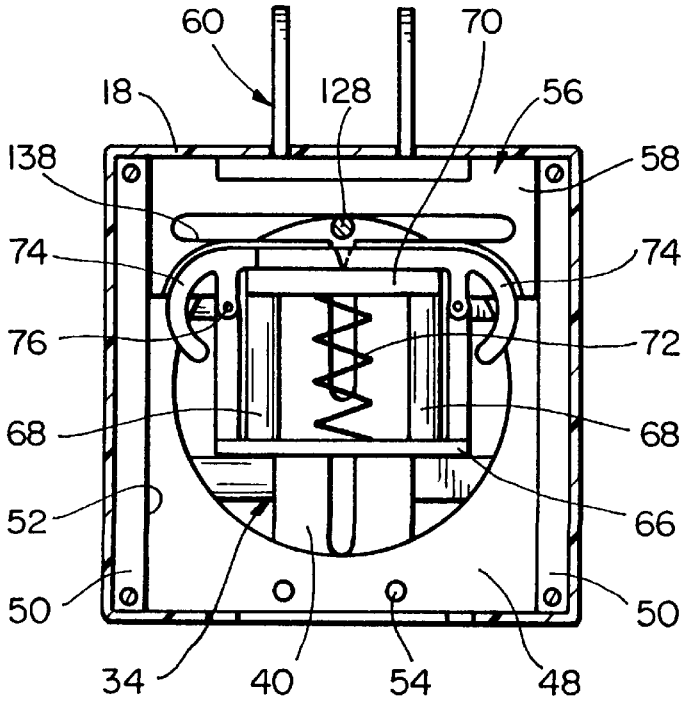
FIG. 11 is a sectional view similar to FIG. 9, partially broken away, shown with a different plug extended from the plug body.

Layer B is shown in FIGS. 5 and 9. Layer B generally includes a base 48 which rests on the lateral flanges 28 of the base 26 and partially covers layer A. The base 48 is similar to the base 26, and includes spaced lateral flanges 50 defining a track 52 therebetween. The base 48 is orientated such that the track 52 is perpendicular to the track 30 of layer A. The base includes a pair of apertures 54 positioned at each end of the track 52. The apertures 54 are substantially aligned with the apertures 32 formed in the lateral flanges 28 of the base 26 for the delivery of the electrical connectors (not shown) to layer B. In the illustrated embodiment, the tracks of both layers A and B are defined by spaced lateral flanges. However, it is to be understood that the track may be provided by a variety of other means for guiding the sliders such as grooves, one or more rails projecting upwardly from the surface of the base to engage the underside of the sliders, and the like.

A pin assembly 56 positioned in the track 52 includes a slider 58 which is shaped to slide along the track 52. A pin set 60 extends from one side of the slider 58. As shown particularly in FIGS. 10A and 10B, the pin set 60 includes a pair of spaced blades 62 which are each carried by a base 64. The base 64 is pivotally mounted to the slider 58 such that the blades 62 may be pivoted between a parallel, vertical orientation (FIG. 10A) to fit North American style outlets and an angled orientation (FIG. 10B) with the blades pivoted 45° from the vertical orientation to fit Australian style outlets. The user manually pivots the blades 62 to the desired orientation after the blades 62 have been moved to the extended, operational position with the blades projecting from the housing 18 of the plug body. Although not shown, the openings in the housing 18 through which the blades 62 are extended are shaped to permit this pivotal movement of the blades. When the blades 62 are extended in the operational position, the electrical connectors in the apertures 54 contact electrical connectors (not shown) on the underside of the slider 58 to couple the blades 62 to the receptacle 12.

Figure 12:
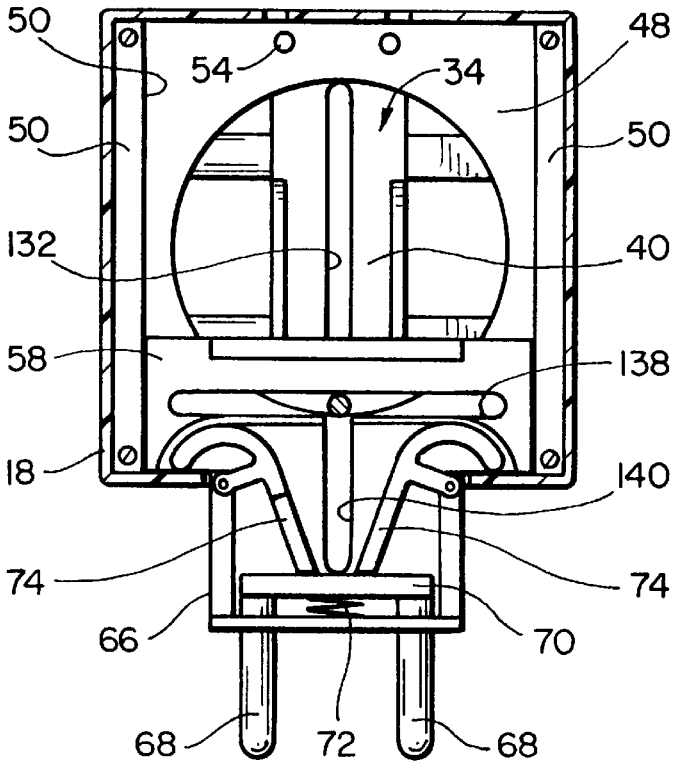
FIG. 12 is a sectional view similar to FIG. 9, partially broken away, shown with a different plug extended from the plug body.

As shown in FIGS. 9 and 11–13, a pin body 66 extends from the side of the slider 58 opposite the pin set 60. The pin body 66 includes a set of pins 68 which are configured to mate with the European style outlets. When this plug is not in use, the pins 68 are retained within the pin body 66 as shown particularly in FIG. 11. As the actuator 16 is rotated relative to the plug body 14, the pins 68 are moved out of the pin body 66 and the pin body 66 is extended from the plug body as shown in FIG. 12. In this position, the plug P4 may be inserted into recessed European style outlets. As shown particularly in FIGS. 11 and 12, the pins 68 are mounted to a transverse base 70. A spring 72 urges the transverse base 70 to the back of the pin body 66, retaining 10 the pins 68 in a retracted position within the pin body 66. A pair of lever arms 74 are pivotally mounted to the pin body 66 by a suitable fastener 76. As the actuator 16 is rotated to move the pin body 66 and pins 68 to the extended position, the lever arms 74 are caused to pivot relative to the base 70, with the distal ends of the lever arms 74 pressing the transverse base 70 toward the forward end of the pin body 66. The opposite ends of the lever arms 74 are curved complementary to the surface of the slider 58 such that the curved ends of the arms slide along the slider 58 as the lever arms 74 are pivoted. The movement of the arms 74 is discussed in more detail below in connection with the description of the actuator 16.

Once the pins 68 are extended, the pin body 66 may be released and pushed into the housing 18 by moving a switch 82. The details of releasing the pin body 66 are discussed in more detail in relation to the actuator. Once released, the pin body 66 may be pushed into the housing 18, moving the slider 58 to an intermediate position along the track as shown particularly in FIG. 13. This plug configuration, where only the pins 68 are extended from the plug body 14, is suitable for use with European style outlets.

When the pins 68 are extended in the operational position, the electrical connectors in the apertures 54 contact electrical connectors (not shown) on the pin body 66 and the underside of the transverse base 70 couple the pins 68 to the receptacle 12. The pins 68 are electrically connected to the receptacle 12 regardless of the position of the pin body 66.

Figure 6:
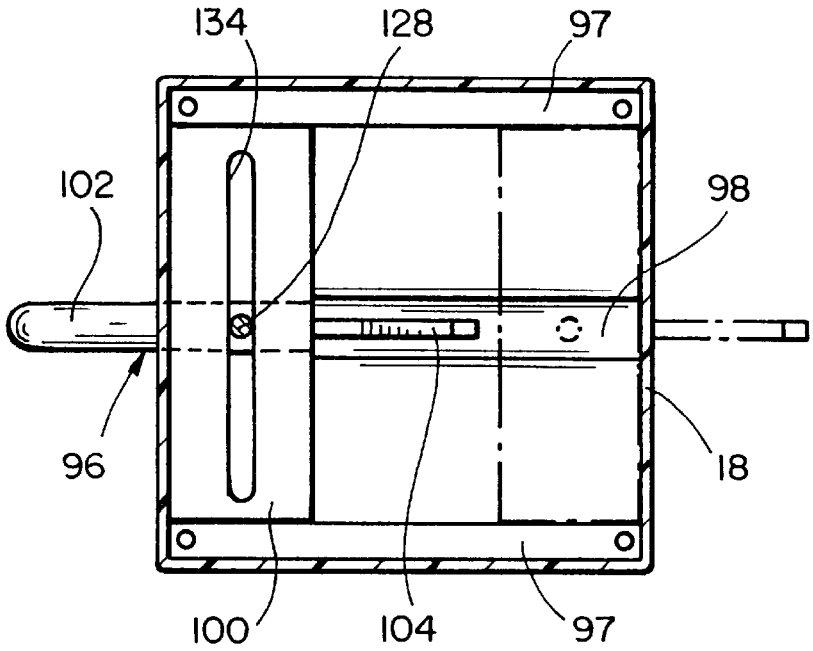
FIG. 6 is a sectional view taken substantially along line 6—6 in FIG. 5.

Layer C, shown in FIGS. 5 and 6, includes a retainer plate 94 (FIG. 5) which covers the components of layer B. A pin assembly 96 is positioned on the retainer plate 94. On this layer, the track which guides the pin assembly 96 as it slides across the retainer plate 94 is provided by lateral flanges 97 provided on the interior of the housing 18 and the raised tunnel 98 formed on the upper surface of the housing 18 (FIG. 1). However, it is to be understood that the retainer plate 94 may include lateral flanges or other means for guiding the pin assembly 96. The pin assembly 96 includes a slider 100 and guide pins 102, 104 mounted to the slider 100. The pins 102, 104 are associated with the plugs which include pins 36 and 38, respectively, of layer A. In the illustrated embodiment, the adaptor 10 is not a grounded unit and the pins 102 and 104 are the guides to the grounding pin locations of the receptacles. In other modifications, the receptacle adaptor may be grounded with the guide pins 102, 104 functioning as grounding pins. The term "guide pins" as used in the specification and claims is intended to encompass the pins 102, 104 of a non-grounded adaptor 10 as well as the grounding pins of a grounded adaptor. The spacing between pins 36 and 38 of layer A and the pins 102, 104 of layer C corresponds to the distance between the corresponding sockets of the outlet. Conveniently, the height of the components of layer B is less than the distance between the pins 36, 38 and the pins 102, 104, allowing the plugs of layer B to be positioned between the pins of the plugs of layers A and C. However, it is to be understood that in other modifications of the invention, the grounding pins may be positioned in the layer immediately adjacent the layer which includes the conductive pins of the plug. As is described below, the slider 100 is moved with the slider 40 such that movement of the pins 102, 104 is synchronized with the movement of the associated pins 36, 38, ensuring all of the pins of the pin configurations will be simultaneously moved to the extended, operational position.

The bases 26 and 48, the retainer plate 94 and the housing 18 of the plug body are secured together by suitable means such as threaded fasteners which are inserted through openings formed in the corners of the bases 26 and 48, the retainer plate 94 and the housing 18. The pin assemblies 34, 56 and 96 are trapped between, but movable relative to, the bases 26 and 48, the retainer plate 94 and housing 18.

The movement of the sliders 40, 58 and 100 is controlled by the actuator 16. As discussed above, the user operates the actuator 16 by gripping the receptacle housing 17 to turn or rotate the housing 17 and actuator 16 relative to the plug body. The sliders 40, 58 and 100 are coupled to the actuator 16 so that the sliders are moved within the housing 18 as the actuator 16 is rotated. Turning to FIG. 5, the upper surface of the housing 17 is stepped so that the housing 17 attaches to the actuator 16. The actuator 16 includes a raised outer ring 112 and central disc 114 which projects upwardly from the outer ring 112. The central disc 114 fits in the central opening 116 formed in the base member 26, while the outer ring 112 nests in a complementary-shaped recess 117 formed in the underside of the base 26. An annular shelf 118 is formed at the edge of the opening 116. The shelf supports a retainer disc 120 which is larger than the opening 116. The retainer disc 120 is mounted to the central disc 114 of the actuator 16 by suitable fasteners such as screws. The base 26 is clamped between, but not secured to, the actuator 16 and the retainer disc 120. The outer ring 112, central disc 114, and retainer disc 120 rotate within the recess 117 and opening 116 formed in the base member 26, respectively, allowing the actuator 16 and receptacle housing 17 to be pivoted relative to the base 26.

As shown particularly in FIG. 8, four notches 122 are formed in the shelf 118 around the opening, each notch corresponding to one of the sides of the plug body 12. In the illustrated embodiment, the notches are substantially aligned with the plugs which are extended from each side of the plug body 14, as is evident from the location of the notches 122 in the middle of each pair of apertures 32. A detent spring 124 is seated in a recess 126 formed in the central disc. When one of the plugs P is moved to the extended, operational position, the detent spring 124 seats in the notch 122 associated with the extended plug P to hold the actuator 16 in place and prevent inadvertent retraction of the extended plug. The detent spring 124 is released from the notch when the user begins to rotate the actuator 16. The amount of force required to dislodge the detent spring 124 from the notch 122 can be applied by a normal turning force and does not require an undue amount of exertion. Once the detent spring 124 is released, rotation of the actuator 16 is relatively unrestricted until the detent spring clicks into the next notch 122. As the actuator is rotated between the notches, the extended plug is retracted while the next plug is extended from the plug body Such that when the detent spring clicks into the next notch 122, the next plug is fully extended from the housing 18.

As shown in FIG. 8, the notches 122 and detent spring 124 are preferably shaped so that the detent spring 124 may be released by rotating the actuator 16 in either a clockwise or counterclockwise direction. Thus, the user may select the most direct path to the desired plug configuration. In the illustrated embodiment, each notch 122 is aligned with one of the plugs and diametrically opposed to the plug associated with the notch. However, it is to be understood that it is not necessary that the notches be aligned with the plugs so long as engagement of the detent spring with a notch coincides with the full extension of the associated plug from the plug body 14.

The actuator includes a coupling pin 128 is mounted to the central disc 114. The coupling pin 128 is diametrically opposed to the detent spring 124 such that the coupling pin 128 is always positioned adjacent the plug which is extended from the plug body 14. The pin 128 projects upwardly from the disc 114 as shown in FIG. 5 such that the pin extends at least up to layer C. The pin 128 couples the pin assemblies 34, 56 and 96 to the actuator 16.

As shown in FIG. 7, the coupling pin 128 extends upwardly through a longitudinally extending slot 132 formed in the slider 40. When the slider 40 is positioned with the pins 36 extended in the operational position, the coupling pin 128 is located at the middle of the slot. The retainer disc 120 rotates relative to the base as the actuator 16 is turned, moving the pin 128 in a circular path around the base as indicated by the interrupted lines in FIGS. 3A–3D. As the disc rotates, the circular path of the pin 128 causes the pin 128 to slide along the slot 132 and exert a force on the slider 40, in the general direction of the arrow, which causes the slider 40 to move along the track 30 toward the opposite side of the plug body 14. When the pin 128 is aligned with the apertures 32 formed in the lateral flange 28, the slider 40 is positioned mid-way along the track and the pin is located at the end of the slot 132 (not shown). Continued rotation of the retaining disc 120 moves the slider to the end of the track 30 such that the pins 38 project from the plug body 14 in the operational position. The slider 40 may be moved back along the track by continuing to turn the actuator 16 in the clockwise direction. In addition, the actuator 16 may be turned in a counter-clockwise direction at any time, in which case the described movement of the slider is reversed.

The coupling pin 128 extends through layer B and engages a longitudinally extending slot 134 formed in the slider 100 of layer C (FIG. 6). As the retainer disc 120 is rotated, the coupling pin 128 slides along the slot 134 and causes the slider 100 to move across the retainer plate 94 in the same manner as the slider 40 is moved across the base 26. The slider 100 moves back and forth between the opposite sides of the plug body, with this movement being guided by the flanges 97 and tunnel 98.

Turning to FIG. 9, the coupling pin 128 extends through a slot 138 formed in the slider 58. When the slider 40 of layer A is positioned so that the pins 36 are in the extended position, the slider 58 is positioned in the middle of the track 52 with pin set 60, pin body 66 and pins 68 retracted in the plug body 14. The coupling pin 128 is positioned at one end of the slot 138. Rotating the actuator in a clockwise direction moves the slider toward the end of the track to extend the pin set 60 in an operational position, shown in FIG. 11. Rotation of the actuator in either direction will return the slider 58 to the position shown in FIG. 9. This movement is accomplished in the same manner as the movement of slider 40.

If the actuator is rotated in a counter-clockwise direction when the slider 58 is in the position shown in FIG. 9, the coupling pin 128 will travel along the slot 138 and exert a force in the direction of the pin body to move the slider 58 along the track 52 and extend the pin body 66 from the housing 18. The curved ends of the lever arms 74 contact the interior of the housing 18 and, as the pin 128 continues to move the slider 58 along the track 52, the lever arms 74 pivot relative to the slider. The distal ends of the lever arms 74 press the transverse base 70 toward the forward end of the pin body 66 to extend the pins 68 from the pin body 66. When the slider has reached the end of the track 52 as shown in FIG. 12, the pin body 66 is extended from the housing and the pins 68 are extended from the pin body 66.

As shown in FIG. 12, in this position the coupling pin 128 is substantially aligned with the transverse slot 140. The pin 128 is prevented from entering the slot 140 by a catch 142 (FIG. 9) pivotally mounted to the interior of the housing of the pin body 66. In the illustrated embodiment, the catch 142 is a disc shaped member formed with an inward extending slot 144. When the switch is in the position shown in FIG. 9, the slot 144 is angled relative to the slot 140 such that a portion 146 of the catch obstructs the opening of the slot 140, preventing the pin 128 from entering the slot so that the pin 128 moves the slider 58 to the position shown in FIG. 12. The catch 142 is integrally formed with the switch, although in other embodiments it is to be understood that the two are separate components. Moving the switch 82 to the right pivots the catch 142 so that the slot 144 is substantially aligned with the slot 140 (not shown). The user may then push the pin body 66 into the housing 18, with the aligned slots 140 and 144 allowing the pin body 66 to slide past the stationary coupling pin 128. Once the pin body 66 has been moved into the housing, the switch 82 returns to the left position so that the catch 142 prevents the pin body 66 from being inadvertently dislodged from the housing 18.

Figure 13:
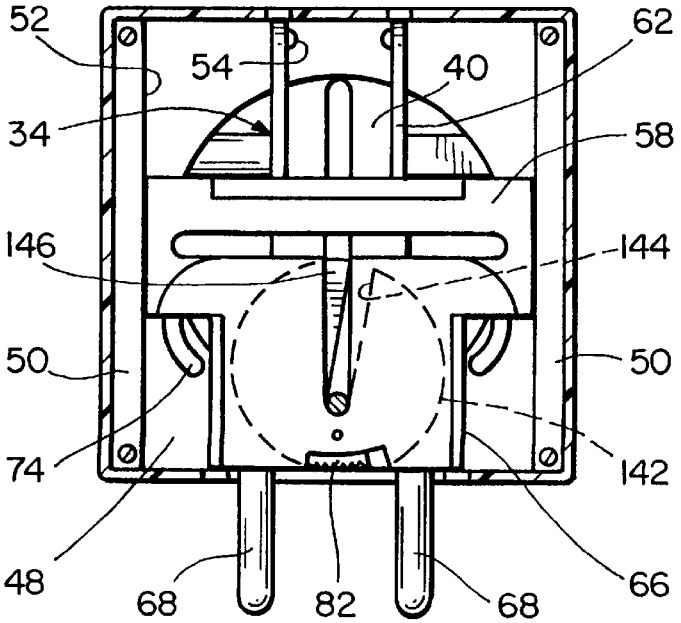
FIG. 13 is a sectional view similar to FIG. 9, shown with a different plug extended from the plug body.

As shown in FIG. 13, the slide 58 is moved to the intermediate position and the lever arms 74 have returned to the initial position shown in FIG. 9 when the pin body 66 is pushed into the housing 18. Retraction of the transverse base 70 is prevented by the coupling pin 128 which holds the pins 68 in the extended position. Before rotating the actuator 16 to retract the pins 68, the switch 82 is moved to release the pin body 66 and the pin body 66 is pulled from the housing 18 returning the pin body 66 and pins 68 to the position shown in FIG. 12. Rotating the actuator in either direction moves the slide 58 along the track 52 to retract the pin body 66 into the housing. With the movement of the slider 58, the spring 72 urges the transverse base toward the slider 58 and pivots the lever arms 74 to their initial positions so that the pins 68 are retracted into the pin body 66.

As is apparent from the above description, rotation of the actuator 16 relative to the plug body 14 produces linear movement of each of the pin assemblies 34, 56 and 96 within the plug body 14. During retraction of the extended plug into the housing 18, the next plug is simultaneously moved to the extended position. The adaptor 10 of this invention is simple to operate, the user need only rotate the actuator 16 in the desired direction relative to the plug body 14. Once extended in the operational position, the plugs P are securely held in place to permit the adaptor to be used without the inadvertent retraction of the plug into the housing 18. The plug P is easily released by merely turning the actuator 16. The adaptor is compact, in the present embodiment the adaptor 10 has a width of about 2.5 inches and a height of about 2.25 inches.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

What is claimed is:

1. An electrical adaptor comprising:

a plug body including an outer wall and a plurality of plugs carried by said plug body, said plugs having different plug configurations, each of said plugs being movable between an extended position, with said plug extending through said outer wall, and a retracted position, with said plug being substantially retracted into said plug body; and an actuator coupled to said plug body, said actuator being continuously rotatable relative to said plug body to move automatically said plugs between the extended position and the retracted position.

2. The electrical adaptor of claim 1 in which said plug body includes at least one slidable base member, said base member having a pair of said plugs mounted thereto with said plugs directed in opposite directions such that one of said pair of plugs extends from one side of said plug body and the other of said pair of plugs extends from another side of said plug body when said pair of plugs are moved to the extended positions, respectively.

3. The electrical adaptor of claim 1 in which a pair of said plugs have first and second pins and a guide pin insertable into a grounding pin location in the receptacle, said plug body including first and second slidable base members, said first and second pins of each of said pair of plugs being mounted to said first base member and said guide pin of each of said pair of plugs being mounted to said second base member, said pins of said pair of plugs being directed in opposite directions such that said pins of one of said pair of plugs extend from one side of said plug body and said pins of the other of said pair of plugs extend from another side of said plug body.

4. The electrical adaptor of claim 1 in which one of said plugs includes a pair of blades, said blades being pivotal between a first orientation in which said blades are substantially parallel to define a first plug configuration and a second orientation in which said blades are oriented at an angle relative to the first orientation to define a second plug configuration.

5. The electrical adaptor of claim 1 in which one of said plugs includes pins carried by a pin body, said pins being movable relative to said pin body between a retracted position, with said pins substantially retracted inside of said pin body, and an extended position, with said pins extending from said pin body, and said pin body being movable relative to said plug body between a recessed position, with said pin body substantially retained in said plug body, and a projecting position, with said pin body projecting from said plug body.

6. The electrical adaptor of claim 1 in which said actuator includes a coupling member carried by said actuator and coupled to said plugs such that rotation of said actuator produces relative movement of said plugs.

7. The electrical adaptor of claim 1 in which said actuator includes at least one receptacle configured to receive the plug of an electrical device, and further comprising electrical connectors configured to electrically connect said receptacle to said plugs when said plugs are in the extended position.

8. An adaptor for coupling an electric device to one of a plurality of outlet configurations comprising:

a plurality of plugs each configured to mate with one of the outlet configurations;

a housing for substantially enclosing said plugs, said housing having openings formed therein for the extension of said plugs from said housing;

a receptacle adapted to receive the plug of the electric device;

an actuator coupled to said plugs, said actuator being rotatable relative to said housing to automatically and successively move one of said plugs through the associated openings to a position with the plug extending through the associated openings and to retract the previously extended plug into said housing; and electrical connectors electrically coupling said receptacle to said plugs when said plugs are in the extended position.

9. The adaptor of claim 8, and further comprising at least one pin assembly slidable within said housing, a pair of said plugs each having pins carried by said pin assembly with said pins of one of said pair of said plugs projecting from said pin assembly in a first direction and said pins of the other of said pair of said plugs projecting from said pin assembly in a second direction different from the first direction, said actuator being coupled to said pin assembly to move said pins of said pair of plugs through the associated openings and to retract said pins of said pair of plugs upon rotation of said actuator relative to said housing.

10. The adaptor of claim 9 in which said pair of plugs each include a guide pin insertable into a grounding location in the receptacle, and further comprising a guide pin assembly slidable within said housing, said guide pins being carried by said guide pin assembly with one of said guide pins projecting from said guide pin assembly in the first direction and the other of said guide pins projecting from said guide pin assembly in the second direction, said guide pin assembly being movable with the first-mentioned pin assembly to move said guide pins through the associated openings and to retract said guide pins into said housing.

11. The adaptor of claim 9, and further comprising at least one track, said pin assembly being slidably disposed in said track for movement of said pin assembly within said housing.

12. The adaptor of claim 9, and further comprising a second pin assembly slidable within said housing, a third one and a fourth one of said plugs having pins carried by said second pin assembly with said pins of said third one of said plugs projecting from said second pin assembly in a third direction and said pins of said fourth one of said plugs projecting from said second pin assembly in a fourth direction different from the third direction, the third and fourth directions being orientated at an angle relative to the first and second directions, said actuator being coupled to said second pin assembly to move said pins of said third and fourth plugs through the associated openings and to retract said pins of said third and fourth plugs upon rotation of said actuator relative to said housing.

13. The adaptor of claim 8 in which one of said plugs includes a pair blades, said blades being pivotal between a first orientation in which said blades are substantially parallel to define a first plug configuration and a second orientation in which said blades are oriented at an angle relative to the first orientation to define a second plug configuration.

14. The adaptor of claim 8 in which one of said plugs includes pins carried by a pin body, said pins being movable relative to said pin body between a retracted position, with said pins substantially retracted inside of said pin body, and an extended position, with said pins extending from said pin body, and said pin body being movable between a recessed position, with said pin body substantially retained in said housing, and a projecting position, with said pin body projecting from said housing.

15. The adaptor of claim 8 in which said actuator includes a coupling pin coupled to said plugs such that when said actuator is rotated relative to said housing, said coupling pin slides said plugs in a pattern such that one of said plugs is moved into an extended position while the previously extended plug is retracted into said housing.

16. An electrical adaptor comprising:

a support body having at least one track;

a pin assembly slidably disposed in said track, said pin assembly including a first pin set extending in a first direction and a second pin set extending in a second direction opposite the first direction, each of said first pin set and said second pin set at least partially defining different plug configurations;

an actuator body rotatably coupled to said support body; and a coupling pin carried by said actuator body and coupled to said at least one pin assembly, said coupling pin transmitting rotational movement of said actuator body into sliding movement of said at least one pin assembly along said track to move said at least one pin assembly between a first position, with said first pin set projecting from said support body, and a second position, with said second pin set projecting from said support body.

17. The electrical adaptor of claim 16 in which said support body includes a second track, and further comprising a second pin assembly slidably disposed in said second track, said second pin assembly including a third pin set and a fourth pin set oppositely directed from said third pin set, each of said third pin set and said fourth pin set at least partially defining different plug configurations.

18. The electrical adaptor of claim 17 in which said coupling pin is coupled to said second pin assembly to slide said second pin assembly along said second track upon rotation of said actuator relative to said support body to move said second pin assembly between a third position, with said third pin set projecting from said support body, and a fourth position, with said fourth pin set projecting from said support body.

19. The electrical adaptor of claim 17 in which said second track is oriented at an angle relative to said first track such that said pin sets each project from said support body in a different direction.

20. The electrical adaptor of claim 17 in which said support body includes a third track parallel to said first track, and further comprising a third pin assembly slidably disposed in said third track, said third pin assembly including a first guide pin and a second guide pin oppositely directed from said first guide pin, said first guide pin cooperating with said first pin set to define a first plug configuration and said second guide pin cooperating with said second pin set to define a second plug configuration.

21. The electrical adaptor of claim 16 in which said support body includes a second track parallel to said first track, and further comprising a second pin assembly slidably disposed in said second track, said second pin assembly including a first guide pin extending and a second guide pin each extending in opposite directions, said coupling pin being coupled to said second pin assembly to slide said second pin assembly along said second track when said first pin assembly slides along said first track to move said second pin assembly such that said first guide pin projects from said support body when said first pin assembly is in the first position and said second guide pin projects from said support body when the first pin assembly is in the second position, said first guide pin cooperating with said first pin set to define a first plug configuration and said second guide pin cooperating with said second pin set to define a second plug configuration.

22. The electrical adaptor of claim 16 in which said first pin set includes a pair of blades, said blades being pivotal between a first orientation in which said blades are substantially parallel to define a first plug configuration and a second orientation in which said blades are oriented at an angle relative to the first orientation to define a second plug configuration.

23. The electrical adaptor of claim 16 in which said second pin set includes pins carried by a pin body, said pins being movable relative to said pin body between a retracted position, with said pins substantially retracted inside of said pin body, and an extended position, with said pins extending from said pin body, and said pin body being movable relative to said pin assembly between a recessed position, with said pin body substantially retained in said support body, and a projecting position, with said pin body projecting from said support body.

24. The electrical adaptor of claim 16 in which said actuator includes at least one receptacle configured to receive the plug of an electrical device, and electrical connectors configured to electrically connect said receptacle to said first pin set and said second pin set when said pin sets project from said support body.

25. The electrical adaptor of claim 16 in which said support body includes a housing having openings formed therein, said first pin set and said second pin set each extending through the associated openings when said pin assembly is moved to the first position and the second position.

* * * * *